United States Patent [19]

Haberkorn

[11] Patent Number: 4,824,037

[45] Date of Patent: Apr. 25, 1989

[54] APPARATUS FOR FREEING THE BOTTOM WRAPS AND THE DOWNWINDS OF YARN FROM A TEXTILE BOBBIN

[75] Inventor: Egon Haberkorn, Radolfzell, Fed. Rep. of Germany

[73] Assignee: W. Schlafhorst & Co., Fed. Rep. of Germany

[21] Appl. No.: 83,266

[22] Filed: Aug. 6, 1987

[30] Foreign Application Priority Data

Aug. 6, 1986 [DE] Fed. Rep. of Germany ..... 3627118

[51] Int. Cl.[4] ..... B65H 54/22; B65H 67/08

[52] U.S. Cl. ..... 242/35.6 E

[58] Field of Search ..... 242/35.6 E, 35.6 R, 242/35.5 R, 18 R, 18 EW

[56] References Cited

U.S. PATENT DOCUMENTS 3,464,640 9/1969 Kupper ..... 242/35.6 E
3,770,220 11/1973 Kupper ..... 242/35.6 E
3,923,264 12/1975 Kupper ..... 242/35.6 E
4,009,840 3/1977 Muller ..... 242/35.6 E
4,103,836 8/1978 Kupper ..... 242/35.6 E

*Primary Examiner*—Stanley N. Gilreath
*Attorney, Agent, or Firm*—Shefte, Pinckney & Sawyer

[57] ABSTRACT

Apparatus for freeing the bottom wraps and the downwinds of yarn from a textile bobbin to provide a free yarn end in preparation for subsequent unwinding of the bobbin, including three bobbin engaging and rotating rollers arranged in a triangle with two of the rollers being driven and the third roller being movable into engagement with the top of the bobbin to rotationally support the bobbin by the three rollers. The axes of rotation of two of the three rollers are skewed with the skewing being related to the direction of rotation to cause an upward component of rotational support of the bobbin to raise it against a stop member and away from a bottom support plate that is then pivoted downwardly to form an opening to accommodate jets of compressed air acting somewhat downwardly against the bobbin to free the downwinds and bottom wraps of yarn.

12 Claims, 3 Drawing Sheets

APPARATUS FOR FREEING THE BOTTOM WRAPS AND THE DOWNWINDS OF YARN FROM A TEXTILE BOBBIN

BACKGROUND OF THE INVENTION

The present invention relates to an apparatus for freeing the bottom wraps and the downwinds of yarn from a textile bobbin to provide a free yarn end in preparation for subsequent unwinding of the bobbin. An apparatus of the general type to which the present invention is directed is disclosed in West German patent document No. DE-AS 15 60 571.

In textile manufacturing yarn is produced and wound onto bobbins and is then transferred onto packages by automatic winders. The last windings of the yarn on the bobbins are in the form of downwinds that spiral from the top of the bobbin down around the body of the yarn and then wound as bottom wraps around the bottom of the bobbin. In some cases only downwinds are formed without bottom wraps.

In preparing bobbins for processing by automatic winders, it is necessary to free predetermined lengths of yarn from the bobbin and preferably position the free ends at a preferred location along the length of the bobbins so that the yarn ends can readily be engaged by the automatic winder. This yarn freeing operation is normally performed by rotating the bobbin and applying pneumatic or mechanical means for acting on the underwindings and bottom wraps of yarn to free the yarn ends and unwind the yarn from the bobbin to a location convenient for subsequent engagement by the automatic winder.

In prior art devices of this type the bottoms of the bobbins are supported on and slide along supports as they are transported to, supported during and transported away from the yarn end freeing operation. Such bottom supports interfere with desired yarn end freeing operation by obstructing free downward pneumatic or mechanical action beyond the bottom ends of the bobbins, but desired elimination of the supports has not been possible because the bobbins must be supported. In this regard, attempts have been made to reduce the undesirable effect of the supports by special shaping, but such attempts have not been successful to the extent desired. It is to this problem that the present invention is directed.

SUMMARY OF THE INVENTION

The present invention eliminates the need for supporting the bottom of bobbins during freeing of the yarn end in preparation for subsequent unwinding by using three rotatable rollers mounted on the frame of the apparatus for engaging the tops of bobbins and rotatably supporting the bobbins independent of any support at the bottom so that the bottom support can be removed and a downwardly acting pneumatic or mechanical action can be applied to free the yarn end downwardly without interference by the support.

Briefly described, the apparatus of the present invention includes a frame with means for supporting the bobbin in a generally vertical disposition. Three rotatable rollers are mounted on the frame for rotation about generally vertical axes and engagable with the circumference of the bobbin adjacent the upper end thereof for rotatable support of the bobbin. Means are provided for rotating at least one of the rollers and at least one of the rollers is mounted with its axis skewed in relation to the axis of at least one of the other rollers to provide rotational support of the bobbin by the rotating rollers independent of the means for supporting the bobbin. Means are also provided for acting on the bottom wrap and downwind yarn of the rotating bobbin to free the yarn.

Preferably, the skew and the direction of rotation of the skewed roller are related to impart an upward component of rotational support to the bobbin and a stop means, which in the preferred embodiment is a freely rotatable bearing member, is mounted on the frame above the bobbin to limit upward movement during rotation.

Also preferably, the supporting means includes a member disposed below the bobbin for supporting the bobbin and being movable away therefrom upon rotational support of the bobbin by the bobbin rotating means, which member in the preferred embodiment is a support plate that is pivotably mounted for movement between an upper bobbin supporting position and a lower inoperative position away from the bobbin. With this arrangement air can be directed at least partially downwardly against the bobbin with the absence of a bottom support permitting passage of the air and entrained yarn downwardly beyond the bobbin for effective freeing.

In the preferred embodiment one of the three rollers is mounted on a shiftable holder that is movably mounted on the frame for movement between an open position in which the mounted roller is out of engagement with the bobbin and an operating position in which the mounted roller engages the bobbin and maintains it in rotational supporting engagement by the three rollers.

Also in the preferred embodiment, the means for rotating the bobbin includes a drive shaft connected to at least one roller that is rotated by the rotating means, a pulley mounted on the drive shaft, a drive belt trained around the pulley, and means for driving the belt. With this arrangement effective driving of the rotating rollers is accomplished, and a plurality of bobbin rotating means may be mounted on the frame in spaced relation with the belt being the common drive for pulleys of the rollers of each bobbin rotating means.

For convenience of assembly and disassembly, two of the three rollers may be mounted in bearings as a subassembly that is mounted on the frame with both of the rollers being driven by the rotating means.

Further features and advantages will be apparent from the accompanying drawings and following descriptions.

DETAILED DESCRIPTION OF THE PREFERRED EMBODIMENT

Figure 1:
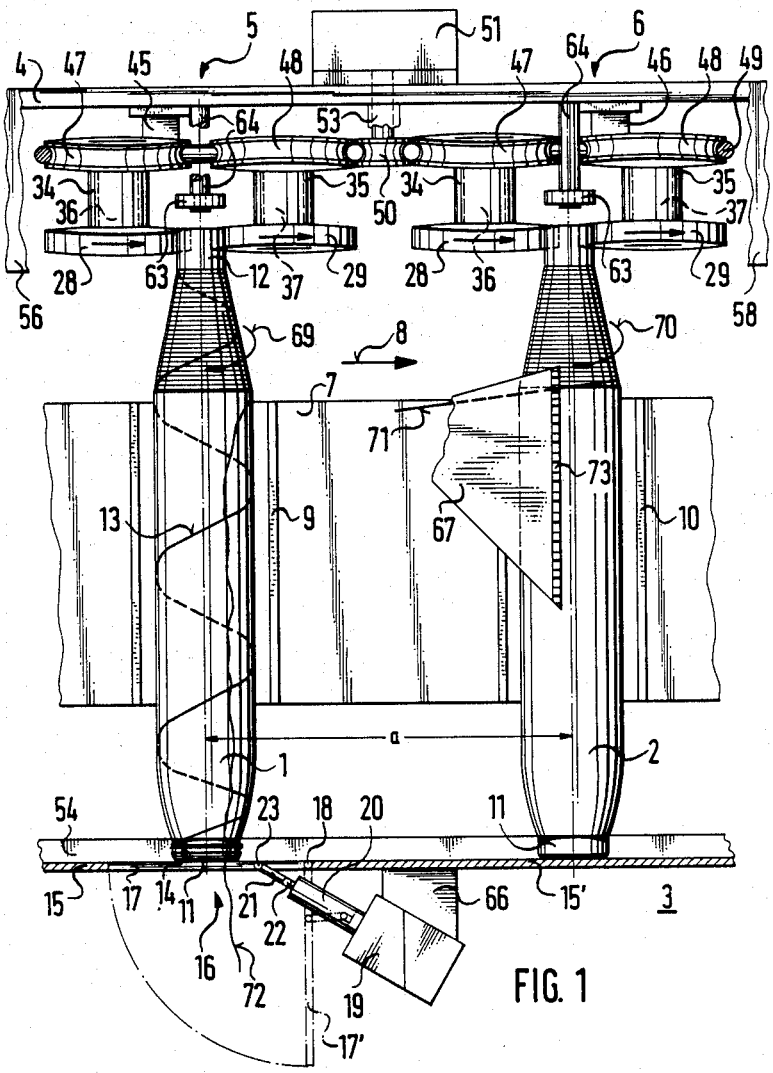
FIG. 1 is a front elevation, partially in section, of an apparatus embodying the preferred embodiment of the present invention.

Referring to the drawings, the apparatus for freeing the bottom wraps and the downwinds of yarn from textile bobbins 1,2 is designated in its entirety by the reference numeral 3. It includes a frame 4 which carries, inter alia, two bobbin rotating means 5,6.

The apparatus 3 includes bobbin supporting means in the form of a conveyor belt 7 and a support plate 15,15'. The conveyor belt 7 has its web vertically disposed and travels horizontally in a previously determined work cycle in the direction of the arrow 8 in an intermittent movement to position bobbins 1,2 for a dwell at the work stations of the bobbin rotating means 5,6. Attached to the conveyor belt 7 at spacings equivalent to the spacing between work stations are vertically disposed U-shaped compartments 9,10 in which the bobbins 1,2 are disposed and transported through the apparatus 3. In the position illustrated in the drawings, the conveyor belt 7 is at rest with the bobbins 1,2 positioned at the bobbin rotating means 5,6.

The bobbins 1,2 illustrated have yarn windings that have been wound on a ring spinning machine on tubes whose feet 11 and top 12 are visible beyond the windings. In winding bobbins of this type the winding progresses from the bottom upward to complete the body of the windings and then the yarn is rapidly wound helically downward, forming downwinds 13 and finally is wound circularly around the tube foot 11 to form bottom wraps 14. In some cases the yarn ends with the completion of the downwinds 13 without bottom wraps 14.

As the bobbins 1,2 are transported by the conveyor belt 7, their feet 11 slide along the surface of the plate 15,15', which supports the bobbins 1,2 in vertical disposition. The plate 15,15' has an opening under the work station for the bobbin rotating means 5, in which opening is mounted a support device 16 that includes a plate 17 pivoted at 18 to the plate 15' and operated by an electromagnetic drive 19 mounted on a support 66 projecting from the support plate 15' of the frame 4. A control rod 20 is advanced and retracted by the drive 19 and has a connecting rod 21 having one end 22 pivoted to the control rod 20 and its other end 23 pivoted to the plate 17 at a spacing from the pivoted connection of the plate 17 to the support plate 15'. In FIG. 1, the pivoted plate 17 is illustrated in its bobbin supporting position as a continuation of the support plate 15,15'. When the electromagnetic drive 19 is actuated, the control rod 20 retracts, pivoting the plate 17 downwardly into a vertical position, illustrated in dot-dash lines in FIG. 1 by the reference numeral 17', so that there is a large opening between the support plate portions 15 and 15'. Thus if strong blasts of air are blown on the bobbin 1, as indicated by the arrows 24–27 in FIG. 2, the air can now escape downwardly in a substantially unimpeded manner without interference from the pivoted plate 17.

Figure 2:
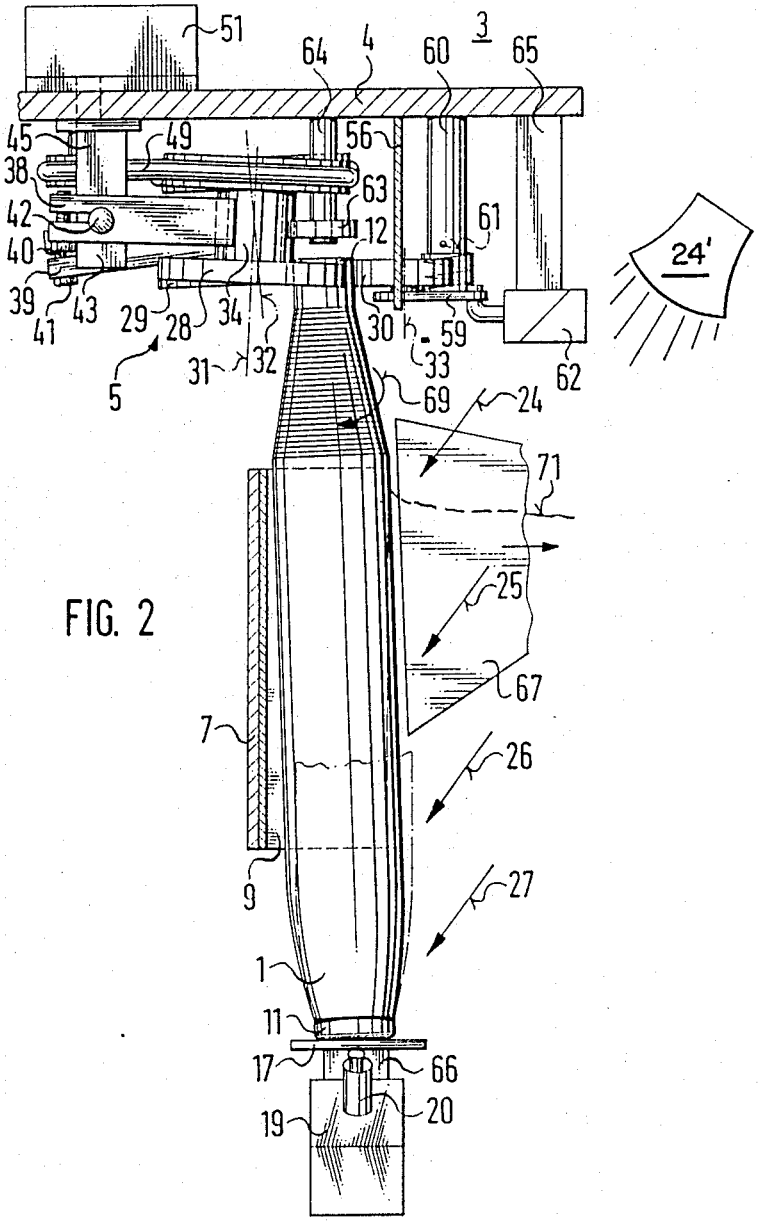
FIG. 2 is a side elevation, partially in section, of the apparatus of FIG. 1.

Each of the bobbin rotating means 5 and 6 are identical in design and the following description applies to both. Each device includes three rollers 28,29 and 30 arranged in a triangle. All three rollers are visible in FIG. 2, but rollers 30 has been omitted from FIG. 1 for clarity of illustration of the other components. In the illustrated embodiment rollers 28 and 29 are driven, and roller 30 is movable into position against the bobbin in the vicinity of the upper end 12 of the tube. As seen in FIG. 2, the axes of rotation 31 and 32 of rollers 28 and 29 are not parallel, but rather are skewed with respect to each other. As a result, the axis of at least one of the three rollers is skewed with respect to the axes of the other two rollers. As seen in FIG. 2, the axis of rotation 31 of roller 28 is inclined to the right and the axis of rotation 32 of roller 29 is inclined to the left while the axis of rotation 33 of roller 30 is vertical.

Rollers 28 and 29 are mounted on the frame 4, with the roller 28 fixed to the lower end of a shaft 36 that is carried in a bearing 34 and the roller 29 fixed to the end of a shaft 37 carried in a bearing 35. The bearings 34 and 35 are fixed to mounting arms 38 and 39, respectively, which have their extending ends bored and slotted for clamping on horizontally projecting ends 42 of a support bar 43,44 that is secured to a frame projection 45,46. The mounting arms 38,39 are adjustably secured on the support bar ends 42 by tightening of screws 40,41 disposed on the arms beyond the support bar ends. In this manner the skewed relation of the axes of the rollers 28 and 29 can be adjusted for optimum performance. The support bar 43,44, mounting arms 38,39, bearings 34,35, shafts 36,37 and rollers 28,29 form a subassembly that can be conveniently disassembled from the frame with the frame projection 45,46.

Figure 3:
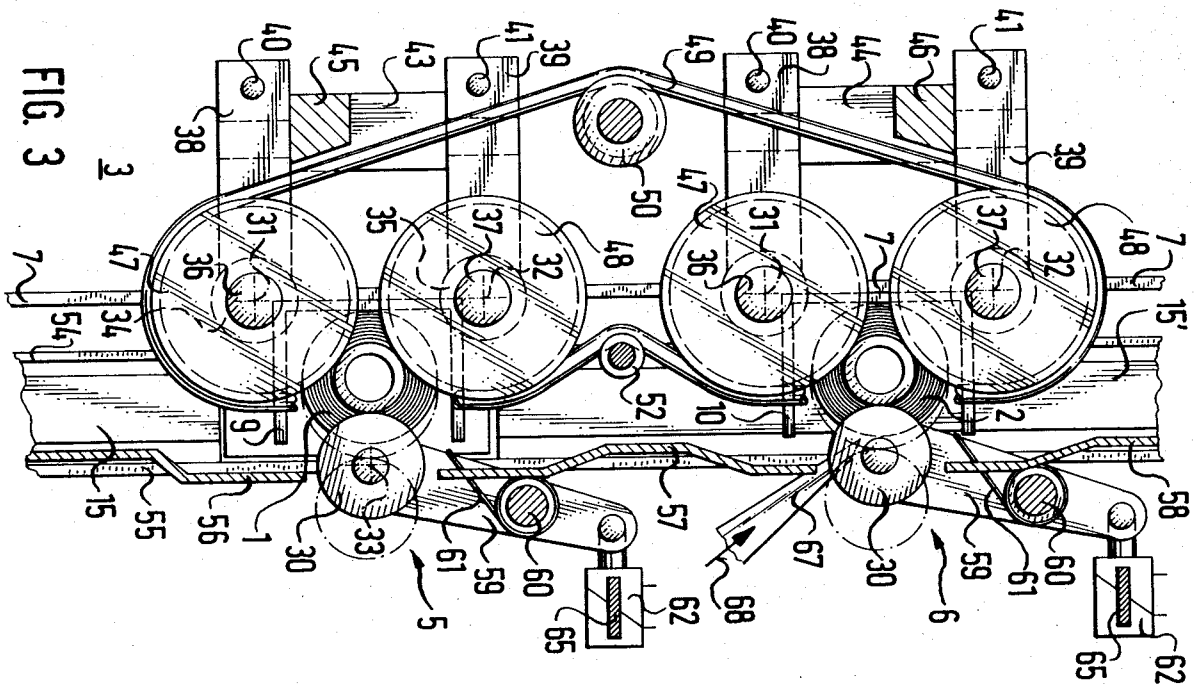
FIG. 3 is a plan view, partially in section, of the apparatus of FIG. 1.

The subassembly also includes belt pulleys 47,48 fixed to the projecting upper ends of the shafts 36,37 and formed with grooves for training therearound an endless drive belt 49 in the form of a round cord. As illustrated in FIG. 3, the drive belt 49 is trained around both pulleys 47 and 48 of both bobbin rotating means 5 and 6 and around a drive pulley 50 that is driven by a drive motor 51 mounted on the frame 4. Thus, the single drive belt 49 drives the pulleys of all of the driven rollers 28 and 29 of both bobbin rotating means 5 and 6. The drive belt 49 is maintained under tension by a tensioning roller 52 mounted in a bearing 53 fixed to the frame 4 as shown in FIGS. 1 and 3.

To prevent the feet 11 of the tubes from moving laterally off the support plates 15,15', the plates are formed with upwardly projecting edges 54,55, and to maintain the tops 12 of the bobbins against lateral movement and in position for engagement by the bobbin rotating means 5 and 6, the frame 12 is provided with vertically extending support walls 56,57 and 58, illustrated in FIG. 3.

The roller 30, illustrated in FIGS. 2 and 3, is freely rotatable and is mounted at the end of a shiftable roller holder 59 for movement against the circumference of the tube in the vicinity of the top 12 thereof. The roller holder 59 is pivotally mounted on a support 60 depending from the frame 4. A helix spring 61 is connected to the support 60 and to the holder 59 in a clockwise direction as viewed from above to tend to urge the holder 59 and roller 30 outwardly away from the bobbin 1,2 to permit advance of the bobbin into position at the work stations for the bobbin rotating means 5,6. An electromagnet 62 is mounted on a downward projecting post 65 from the frame 4. The electromagnet 62 includes a rod that is connected to the roller holder 59 at an end opposite from the roller 30 to effect clockwise rotation of the holder 59 upon energization of the electromagnet 62 to cause the roller 30 to move into contact with the top 12 of the bobbin and force it into engagement with the driven rollers 28 and 29, as illustrated in FIG. 3, which for sake of clarity of illustration, does not illustrate the skewed relationship of the axes of the rollers.

As illustrated in FIGS. 1 and 2, each bobbin rotating means 5 and 6 includes stop means in the form of a rotatable bearing 63, shown as a roller mounted on a support 64 projecting downwardly from the frame 4. This stop means is disposed directly above the top 11 of a bobbin 1,2 that is at the work station. The direction of skewing of the axes 31,32 of the rollers 28,29 in relation to the direction of rotation imparts an upward component of rotational support of the engaged bobbins 1,2 to raise the bobbins upwardly off the support plates 15' and 17, with the rollers 63 serving as freely rotatable bearing members to limit upward movement of the bobbins.

In the position illustrated in the drawings, the conveyor belt 7 is at rest with one bobbin 1 under the bobbin rotating means 5 at one work station and another bobbin 2 under the bobbin rotating means 67 at the adjacent work station. In the illustrated position the pivoted support plate 17 is in its raised bobbin supporting position and the electromagnets 62 have been energized to shift the rollers 30 into bobbin engagement with the drive rollers 28 and 29 to cause the first bobbin 1 to rotate in the direction of the curved arrow 69 and the second bobbin 2 to rotate in the direction of the curved arrow 70, in FIG. 1. At this point the electromagnetic drive 19 is then actuated to lower the pivoted support plate 17 away from the bottom 14 of the bobbin 1 as both bobbins are raised from the support plates 15 and 15' by rotation of the skewed rollers 28 and 29.

Means 24' in the form of compressed air then acts in a conventional manner in the direction of the arrows 24–27 in FIG. 2 with a downward component against the windings of the rotating first bobbin 1 to cause a loosening and freeing of the bottom windings 14 and the downwindings 13 with the air blowing the yarn end downwardly and unwinding the bottom wraps 14 and downwindings 13 to leave a yarn end 72 extending freely from the upper portion of the bobbin 1, as shown in FIG. 1. A conventional pair of scissors, not shown, is then automatically actuated to sever excess yarn from the yarn end 72.

At the same time that the above-described operation is occurring at the first work station, the second bobbin 2 at the second work station is also be rotated and raised from the support plate 15' and a conventional suction nozzle 67 is moved in the direction of arrow 68 in FIG. 3 to a position with its mouth adjacent the surface of the bobbin 2 for drawing the yarn end 71 that had been freed in the preceding work station into the suction nozzle 67 as the bobbin 2 rotates in the direction of the curved arrow 70 of FIG. 1 and to hold the yarn end 71 initially as the bobbin 2 is subsequently transported from the work station in the direction of the arrow 8.

After a predetermined time, the pivoted support plate 17 is raised with the end 72 of yarn shortened by the action of the scissors being above the plate 17. Then, the electromagnets 62 are deenergized so that the shiftable roller holders 59 under the influence of the springs 61 pivot the rollers 30 away from the bobbins 1 and 2 to release the bobbins to fall onto the pivoted plate 17 at the first work station and the support plate 15' at the second work station, respectively. At this time the conveyor belt 17 is advanced in the direction of the arrow 8 a distance equivalent to the spacing a between the centers of the work stations, causing the bobbin from the first work station to move into proper position at the second work station.

At the end of the cycle as described above, the second bobbin 2 is advanced in the direction of arrow 8 away from the second work station with the yarn end 71 maintained under the influence of the suction nozzle 67, which can have a toothed strip 73 at its mouth for this purpose. Subsequently, the yarn end 71 may be engaged in some conventional manner not shown and either withdrawn from the suction nozzle 67 or cut to a shortened end, creating a loose yarn piece that is removed by the suction nozzle 67.

One of the advantages of the apparatus of the present invention is that it is not subject to considerable wear and tear and has a long service life that is not subject to sudden operational malfunctions. Moreover, the apparatus provides optimum freeing of the downwindings and bottom wraps of yarn so that the rate of successful operations is improved in comparison with conventional devices.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for freeing the bottom wraps and the downwinds of yarn from a textile bobbin to provide a free yarn end in preparation for subsequent unwinding of said bobbin, said apparatus comprising a frame, means for supporting the bobbin on the frame in a generally vertical disposition, three rotatable rollers mounted on said frame for rotation about generally vertical axes and engagable with the circumference of said bobbin adjacent the upper end thereof for rotatable support of said bobbin, means for rotating at least one of said rollers, at least one of said rollers being mounted with its axis skewed in relation to the axis of at least one of the other rollers to provide rotational support of said bobbin by said rotating rollers independent of said bobbin supporting means, and means acting on said bottom wraps and downwind yarn of said rotating bobbin to free said yarn.

2. Apparatus for freeing the bottom wraps and the downwinds of yarn from a textile bobbin according to claim 1 and characterized further in that the skew and direction of rotation of said skewed roller are related to impart an upward component of rotational support to said bobbin.

3. Apparatus for freeing the bottom wraps and the downwinds of yarn from a textile bobbin according to claim 2 and characterized further by stop means mounted on said frame above said bobbin to limit upward movement of said bobbin during rotation by said rollers.

4. Apparatus for freeing the bottom wraps and the downwinds of yarn from a textile bobbin according to claim 3 and characterized further in that said stop means is a freely rotatable bearing member rotatable with said bobbin upon contact therewith.

5. Apparatus for freeing the bottom wraps and the downwinds of yarn from a textile bobbin according to claim 1 and characterized further in that said bobbin supporting means includes a member disposed below said bobbin for support thereof and movable away therefrom upon rotational support of said bobbin by said rotatable rollers.

6. Apparatus for freeing the bottom wraps and the downwinds of yarn from a textile bobbin according to claim 1 and characterized further in that said acting means is means directing air at least partially downwardly against said bobbin to entrain the end of yarn, and said bobbin supporting means includes a member disposed below said bobbin for support thereof and movable away therefrom upon rotational support of said bobbin by said rotatable rollers to permit passage of said directed air and entrained yarn end downwardly beyond said bobbin.

7. Apparatus for freeing the bottom wraps and the downwinds of yarn from a textile bobbin according to claims 5 or 6 and characterized further in that said support means member is a support plate pivotably mounted on said frame for movement between an upper bobbin supporting position and a lower inoperative position away from said bobbin, and said supporting means includes means for pivoting said support plate between said positions.

8. Apparatus for freeing the bottom wraps and the downwinds of yarn from a textile bobbin according to claim 1 and characterized further by a shiftable roller holder movably mounted on said frame and having one of said rollers mounted thereon, means for shifting said holder between an open position in which said mounted roller is out of engagement with said bobbin and an operating position in which said mounted roller engages said bobbin and maintains it in rotational supporting engagement by said three rollers.

9. Apparatus for freeing the bottom wraps and the downwinds of yarn from a textile bobbin according to claim 1 and characterized further in that said means for rotating includes a drive shaft connected to said at least one roller rotated by said rotating means, a pulley mounted on said drive shaft, a drive belt trained around said pulley, and means for driving said belt.

10. Apparatus for freeing the bottom wraps and the downwinds of yarn from a textile bobbin according to claim 9 and characterized further in that said rotatable rollers and roller rotating means form bobbin rotating means and characterized further by a plurality of said bobbin rotating means mounted on said frame in spaced relation with said belt being the common drive for pulleys of rollers of each of said bobbin rotating means.

11. Apparatus for freeing the bottom wraps and the downwinds of yarn from a textile bobbin according to claim 1 and characterized further in that said rollers are formed with bobbin engaging surfaces of elastomeric material.

12. Apparatus for freeing the bottom wraps and the downwinds of yarn from a textile bobbin according to claims 1, 8, 9, or 10 and characterized further by a mounting member on which two of said three rollers are mounted in bearings as a subassembly that is mounted on said frame with both of said rollers being driven by said rotating means.

* * * * *